US008839559B2

(12) United States Patent
Neff

(10) Patent No.: US 8,839,559 B2
(45) Date of Patent: Sep. 23, 2014

(54) DOOR URGING APPARATUS

(76) Inventor: Garry D. Neff, Lakewood, CO (US)

( * ) Notice: Subject to any disclaimer, the term of this patent is extended or adjusted under 35 U.S.C. 154(b) by 497 days.

(21) Appl. No.: 12/943,920

(22) Filed: Nov. 10, 2010

(65) Prior Publication Data

US 2012/0110910 A1 May 10, 2012

(51) Int. Cl.

| | |
|---|---|
| ***E05F 11/08*** | (2006.01) |
| ***E05F 3/02*** | (2006.01) |
| ***E05F 3/18*** | (2006.01) |
| *E05F 11/54* | (2006.01) |

(52) U.S. Cl.

CPC ..... *E05F 3/02* (2013.01); *E05Y 2900/512* (2013.01); *E05F 3/18* (2013.01); *E05F 11/54* (2013.01)

USPC ..... 49/344; 49/324; 49/339

(58) Field of Classification Search

USPC ..... 49/324, 339, 340, 344, 345, 400, 401; 16/66

See application file for complete search history.

(56) References Cited

U.S. PATENT DOCUMENTS

| | | | | |
|---|---|---|---|---|
| 3,976,024 | A | 8/1976 | Fillary | |
| 4,075,788 | A * | 2/1978 | Anderson | 49/324 |
| D292,511 | S * | 10/1987 | Brown et al. | D12/317 |
| 4,811,680 | A | 3/1989 | Genth | |
| 5,667,268 | A | 9/1997 | Bump | |
| 5,829,098 | A * | 11/1998 | Alonso | 16/71 |
| 6,105,529 | A | 8/2000 | Kyle | |
| 6,167,589 | B1 * | 1/2001 | Luedtke | 16/71 |
| 6,572,182 | B2 | 6/2003 | Lamparter et al. | |
| 6,634,059 | B2 * | 10/2003 | Seiferd | 16/71 |
| 6,640,387 | B2 * | 11/2003 | Alonso | 16/72 |
| 6,789,293 | B2 * | 9/2004 | Habegger et al. | 16/343 |
| 7,146,766 | B2 * | 12/2006 | Finkelstein | 49/324 |
| 2007/0209160 | A1 * | 9/2007 | Darscheid et al. | 16/334 |

* cited by examiner

*Primary Examiner* — Katherine Mitchell
*Assistant Examiner* — Shiref Mekhaeil
(74) *Attorney, Agent, or Firm* — Roger A. Jackson

(57) ABSTRACT

A door urging apparatus, for use with an existing door hingedly mounted in a frame, the door moving between a closed, a crossover, and open states, the door urging apparatus including an offset bracket with a base and an arcuate planar element having a proximal end that extends from the base and a distal end with a first pivotal attachment. Also included is a plate affixed to a frame portion opposite of the hinged mount, the plate having a second pivotal attachment. Further included is a gas spring assembly having a lengthwise cylinder with a telescoping rod, the gas spring provides a dampened force extending the rod outward. The gas spring is pivotally attached between the first pivotal attachment and the second pivotal attachment, wherein operationally the door is urged into the open state by the gas spring and is also urged into the closed state by the gas spring.

4 Claims, 10 Drawing Sheets

DOOR URGING APPARATUS

TECHNICAL FIELD

The present invention relates generally to a door urging apparatus. More particularly, it relates to an apparatus for urging a hatch door to a substantially fully open positional state and suspending the hatch door in the open position and further to help urge the hatch door into closed positional state.

FIELD AND BACKGROUND

Vehicles of all types typically have storage compartments or areas that are accessible either from the interior of the vehicle or the exterior of the vehicle, normally the access to these storage compartment areas is from the exterior of the vehicle which is accommodated through a door or alternatively termed a hatch, wherein this hatch on a land-based vehicle is typically mounted in a vertical wall and on a marine vehicle a horizontal wall, typically termed a deck. In either case the hatch typically has a locking latch to lock it in the closed operational state and also has some form of retainer to secure the hatch door in the open operational state as with the vehicle having movement it is preferred that the hatch be secured in either the closed operational state or the open operational state. For securing the hatch door and the open operational state a clasp is typically used to secure the door on an adjacent area on the vertical or horizontal surface adjacent to the hatch as in the case of the land or marine vehicle respectively.

Specifically in the case of a land-based vehicle, wherein as previously stated the hatch doors mounted on a vertical wall the clasp that holds the hatch door in the open operational state is holding the hatch door open as against the forces of gravity such that a failure of the clasp could result in injury to a person who is utilizing the access of hatch into and out of the storage compartment, such that a failure of the clasp would result in the hatch door falling and coming in contact with the person possibly causing injury, this as opposed to the marine vehicle application wherein on a horizontal surface the hatch door would typically stay open in place against a horizontal surface even if the clasp failed. So for the land vehicle vertical mounting configuration for the door hatch, the clasp for securing the door into the open operational state becomes even more important for the previously mentioned safety issues and further for the process of opening the door hatch, i.e. in going from the closed operational state to the open operational state wherein the process of manually moving the door hatch could also result in harm the person opening door hatch if it were to slip out of their hand while lifting as it could cause physical harm as the force of gravity is always acting upon the door hatch causing it to fall during the opening process, this as opposed to for example to a conventional building entrance door that opens laterally being hinged vertically that is not affected by gravity. Wherein, if the conventional building entrance door were let go of during the process of going from the closed to the opened state or from the open state to the closed state, the door would not fall from the force of gravity on to the person using it. Thus the vertically mounted door hatch that typically hinges upon the upper surface is more critical in the area of the particular apparatus that urges the door from the closed state to the open state and then returning to the closed state, while at the same time suspending the hatch door securely in the open state.

The prior art in this area in so far as hatch doors is primarily associated with the marine arts, in other words the hatch doors are typically mounted horizontally wherein the effects of gravity in going from the closed state the open state are not as much of a consideration outside of some need for retaining the door in the open state due to the inherent movement of the marine vehicle or vessel. Further, a lot of the priority in the marine area on the hatch door apparatus is to accommodate moving the hatch door from the closed state to the open state and back to the closed state, are concerned with the ability of opening the door for a full 180° to maximize hatch opening access, which can require special hinges on the hatch door and also on the urging apparatus for helping the door open under its own power need to have extra hinged joints where expansions and decoupling are needed to allow the hatch door to open the 180°.

Looking specifically at the typical prior art in the above mentioned areas and in particular starting with the marine hatch door arts, in U.S. Pat. No. 4,811,680 to Genth, disclosed is a deck hatch assembly for marine craft that is formed in the upper deck surface of the marine craft on the port and starboard sides. In Genth, a submerged surface is integrally formed in the upper deck surface, being provided with a hatch opening surrounded by a raised peripheral ridge. The raised ridge in Genth, together with the submerged surface and the upper deck surface, forms a drain channel for directing water away from the stern of the marine craft. A pivotably mounted hatch cover in Genth is provided for normally sealing and closing off the hatch opening. The hatch cover in Genth may be raised upwardly from the bulkhead of the marine craft toward the stern for the purpose of providing ventilation to below deck compartments and for allowing access to the upper deck surface from below deck areas. A pair of gas spring assemblies in Genth is provided for positively and automatically retaining the hatch cover in the closed, or any one of a number of open positions. The hatch cover in Genth, in the closed position, is completely flush with the upper deck surface and is adapted to conform to the configuration of any deck, including styling lines thereof. Note that in particular in Genth in FIG. 2, that the gas spring assemblies 54 have simple pivotal attachments to the frame side walls 20 and the door 42, thereby restricting the door movement in the fully open position to about what is shown in FIG. 1, being less than ninety degrees, thus restricting the utility of Genth. Note that Genth does not urge the hatch door also into a closed operational state.

Continuing, in the marine hatch door arts in looking at U.S. Pat. No. 3,976,024 to Fillery disclosed is a hatch assembly for a boat that has a hatch cover and a hatch mounting frame to which the cover is hinged by releasable hinges, there being two espagnolette bolts serving the dual functions of hinging and latching the hatch cover to the mounting frame. Retraction of either espagnolette bolt at will from an associated hinge receiver on the mounting frame enables the hatch cover to be swung open left or right handedly, and retraction of both bolts from their receivers enabling the hatch cover to be lifted clear of the mounting frame. Thus, Fillery recognizes the problem identified in Genth or the restricted hatch door opening movement, being limited to about ninety degrees at the most, as Fillery has the espagnolette bolts that essentially allow the hatch door to be removed from its frame, while the stay members 18 are detachable all therefore allowing the hatch door to lay flat on the horizontal surface, see FIG. 4.

Continuing, in a much similar invention, in U.S. Pat. No. 6,105,529 to Kyle disclosed is a hatch assembly that has a function very much like Fillery, in that in Kyle being also for a marine vessel includes an outer frame and a hatch cover hingedly attached to the outer frame on one side thereof. The Kyle assembly also includes an elongated hatch adjuster comprising a telescoping rod assembly which includes an outer tube, a tubular extension and a flexible coupling which connects the tubular extension and outer tube in axial alignment when in a first position, see FIG. 3A in particular. The rod in Kyle is slidably received within the outer tube and tubular extension and maintains the assembly in axial alignment as the hatch cover is rotated from a closed position to an angle of at least about 135 degrees, being far more that Genth's opening limitation of being less that ninety degrees. As the hatch cover in Kyle approaches 180 degrees, the rod is withdrawn out of the outer tube which permits the flexible coupling to bend so that the hatch cover can be rotated a full 180 degrees, thus the has a moveable joint at 18, see FIG. 3B, that allows the telescoping rod assembly (being designed for securing the door at any position between fully open and fully closed) bend an additional amount via spring 18 as shown in FIG. 3A, plus an additional telescoping of rod 16 to completely facilitate the full 180 degree door opening, as shown in FIGS. 3A and 3B. The hatch assembly in Kyle also includes a clamp for fixing the rod 20 and outer tube 14 in a fixed position to thereby maintain the cover in a preselected position with respect to the frame. Although Kyle does accomplish the function of allowing the door to fully open to the 180 degrees, it has a high degree of mechanical complexity in requiring a higher number of parts in the assembly.

Moving away from the marine hatch door arts and into the general hatch door arts for a vehicle roof for an escape hatch in U.S. Pat. No. 6,572,182 to Lamparter, et al. disclosed is a motorized vent and escape hatch assembly has a mounting ring fastened to a vehicle roof around a hatch hole, and a hatch cover that is attached to the mounting ring by a first over center hinge linkage mechanism pivotally connecting one side of the hatch cover to the mounting ring and a second over center mechanism pivotally connecting an opposite side of the hatch cover to the mounting ring. Each over center hinge linkage mechanism in Lamparter, et al., has first and second lever members pivotally connected to the mounting ring at one end, first and second plungers that are connected to the respective first and second plungers at the opposite end and that extend into opposite ends of a tube that is connected to the hatch cover. A compression spring in Lamparter, et al., located in the tube, biases the first and second plungers away from each other. Each over center hinge linkage mechanism in Lamparter, et al. is associated with a drive mechanism that pivots the first and second lever members toward or away from each other to raise or lower its side of the hatch cover with respect to the mounting ring. Each drive mechanism in Lamparter, et al. includes first and second gear housings attached to the mounting ring, first and second gear sets disposed inside the respective gear housings, first and second electric motors attached to the respective gear housings for driving the first and second gear sets, and first and second output shafts that are driven by the first and second gear sets and that extend out of the first and second gear housings respectively with the first and second lever members being keyed to the first and second output shafts respectively. The gear sets in Lamparter, et al. are compound gear trains that reduce speed and increase torque.

Next, moving to the land based vehicle arts for a hatch door that opens primarily at an upward angle looking in at U.S. Pat. No. 5,667,268 to Bump disclosed is a protective door system and its complementary box-type structurally-secure service compartment mounted on a firm base, which comprises a slanted roof as a modification of the service compartment on a door side wherein the angle of slant is between about 30 and 60 degrees below horizontal and represents no more than one-third of the total roof area. Further, in Bump a structurally-secure door opening as a modification of the service compartment on a door side, wherein the opening extends from within two feet of the horizontal roof to a location along the vertical wall of the service compartment, and a structurally-secure protective door fitting into the door opening is matched with a weather-type seal, fastened with hinges overhead at its junction with the roof, and secured with a latch at its junction with the vertical wall, wherein the door was made with the same dimensions and slant angle as the slanted roof and vertical side openings. Finally, Bump has a pivoting brace attached in a structurally-secure manner between the protective door and said service compartment to allow multiple open door positions, and the brace pivots at its service compartment attachment. Here in Bump the maximum raised position of the upper slanted portion of said protective door allowance is no more than about 60 degrees above the horizontal, see column 2, lines 43-65 and FIG. 4, or for a total door opening angle of about ninety degrees that the member 33 allows for, being much the same as Genth for not having any special member 33 mountings other than is assumed as a conventional pivotal mounting attachment for the lifter member 33, as there is no teaching evident in Bump relating to unique pivotal attachments of lifter member 33 pivotal mounting.

The prior art has simply not solved the problems encountered while moving the hatch door in a vertically mounted position from the closed to the open operating states to facilitate an assisted door opening function with a door urging apparatus that provides for nearly 180 degrees of opening while suspending the door safely in the open positional operating state, being suspended vertically upward. Furthermore, when the door is closed from the open positional state to the closed positional state, the closing movement should be dampened to counter balance the weight of the door, thus resulting in the door being pushed downward to close until the door is nearly closed, wherein the door urging apparatus then reverses itself to pull the door shut, making the door security latching an easy process, as opposed to the door urging apparatus fighting the ability of the user to close and latch the door securely shut, which would require the user to continuously apply force to hold the door in the fully closed position to effectuate the latching to secure or lock the door in the closed operating position state.

SUMMARY OF INVENTION

Figure 1:
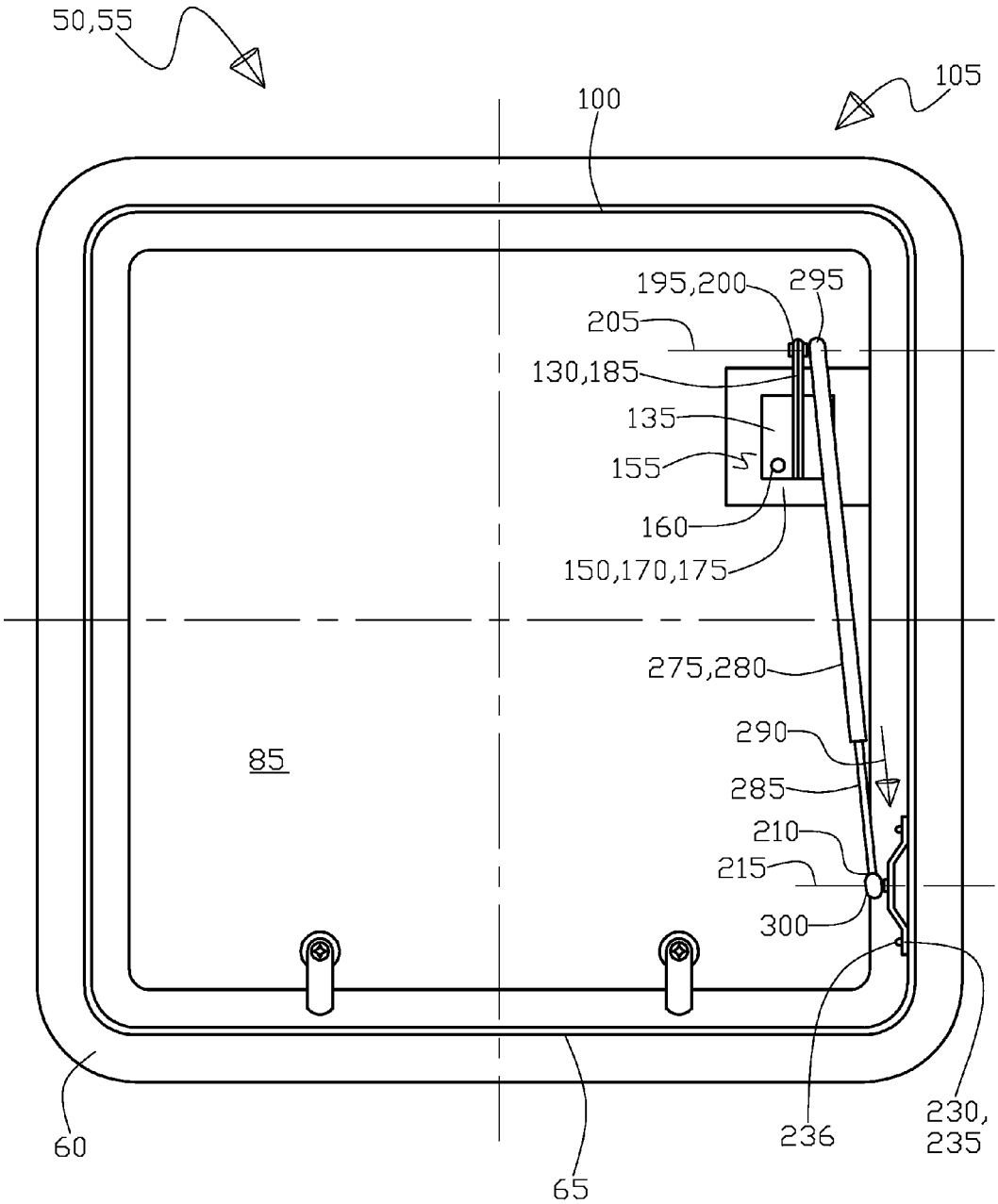
FIG. 1 shows an inside flat view of the door urging apparatus and the door apparatus including the door, the frame, the frame perimeter, the offset bracket, the base, the reinforcement element, the arcuate planar element, the first and second pivotal attachments, and the gas spring assembly, all in the closed operational state.

The present invention is a door urging apparatus, that is for use with an existing door hingedly mounted in a frame, with the door moving via the hinged mount about a hinge axis relative to the frame between a closed operational state, a crossover operational state, and an open operational state, with the door urging apparatus including an offset bracket that has a base forming a plane, with the base having a centrally positioned base axis that is perpendicular to the plane. Further included is an arcuate planar element having a proximal end portion and a distal end portion, wherein the proximal end portion extends substantially perpendicularly therefrom the base and the distal end portion terminating in a first pivotal attachment, the first pivotal attachment having a first pivotal axis, wherein the first pivotal axis is parallel to the plane and perpendicular to the base axis, forming a first distance from the plane to the first pivotal axis and a second distance from the base axis to the first pivotal axis. Wherein the first distance is in the range of about zero point five (0.5) to one point five (1.5) times the second distance, wherein the base is affixed to the door such that the first pivotal axis and the hinge axis are parallel and adjacent to one another.

Also included is a plate with a second pivotal attachment projecting therefrom, the second pivotal attachment has a second pivotal axis that is positioned parallel to the first pivotal axis, wherein the plate is affixed to a frame portion opposite of the hinged mount. A connective axis is formed from the first pivotal axis to the second pivotal axis, wherein the connective axis is parallel to each of the first and second pivotal axes. Further a relational axis is formed from the second pivotal axis to the hinge axis, wherein the relational axis is parallel to each of the second pivotal axis and the hinge axis. Further included is a gas spring assembly having a lengthwise cylinder with a rod telescoping therefrom, wherein the gas spring assembly provides a dampened force extending the rod outward. The gas spring assembly is pivotally attached as between the first pivotal attachment and the second pivotal attachment, wherein operationally the door is in the cross over operational state when the connective axis and the relational axis are in alignment to one another, wherein the door is urged into the closed operational state in going from the cross over operational state to the closed operational state. Further, the door is urged into the open operational state in going from the cross over operational state to the open operational state. The first and second distances are also sized to have the connective axis intersect the base and the base axis intersection when the door is in the open state resulting in no moment loading translating from the base to the door when the door is secured in the open operational state.

REFERENCE NUMBERS IN DRAWINGS

50 Door urging apparatus
55 Door apparatus
60 Frame
65 Frame perimeter
70 Hinge
75 Hinge axis
80 Hinge affixed to a portion of the frame 60
85 Door
90 Door affixed to hinge 70
95 Movement of door 85 about hinge axis 75
100 Door sized and configured to slidably fit within the frame perimeter 65 in the closed operational state 105
105 Closed operational state of door 85
110 Urging of door 85 into the closed operational state 105
115 Crossover operational state of door 85
120 Open operational state of door 85
125 Urging of door 85 into the open operational state 120
130 Offset bracket
135 Base of offset bracket 130
140 Plane formed by base 135
145 Axis of base 135
150 Base 135 affixed to door 85
155 Area of base 135
160 Fastener of base 135
165 Perpendicular relationship
170 Reinforcement element
175 Area of reinforcement element 170
180 Adhesive of reinforcement element 170
181 Primer for adhesive 180
185 Arcuate planar element
190 Proximal end portion of arcuate planar element 185
195 Distal end portion of arcuate planar element 185
200 First pivotal attachment
205 First pivotal axis

210 Second pivotal attachment
215 Second pivotal axis
220 First distance
225 Second distance
226 Third distance
230 Plate
235 Affixing of plate 230 to frame portion opposite of the hinged mount 80
236 Fasteners of plate 230 to frame portion opposite of the hinged mount 80
240 Connective axis
245 Relational axis
250 Alignment of the connective axis 240 and the relational axis 245
255 Connective axis intersecting the base 135 and base axis 145
260 Acute angle formed from connective axis 240 and the relational axis 245 when door 85 is in the open state 120
265 Adjacent acute angle formed from connective axis 240 and the relational axis 245 when door 85 is in the closed state 105
270 No moment loading from base 135 to door 85 in the open operational state 120
275 Gas spring assembly
280 Lengthwise cylinder
285 Telescoping rod
290 Dampened force extending rod 285 outward
295 First pivotal attachment of gas spring assembly 275
300 Second pivotal attachment of gas spring assembly 275
305 Abrasive surface prep block
310 Recreational vehicle
315 Vertical wall of the recreational vehicle

DETAILED DESCRIPTION

Figure 2:
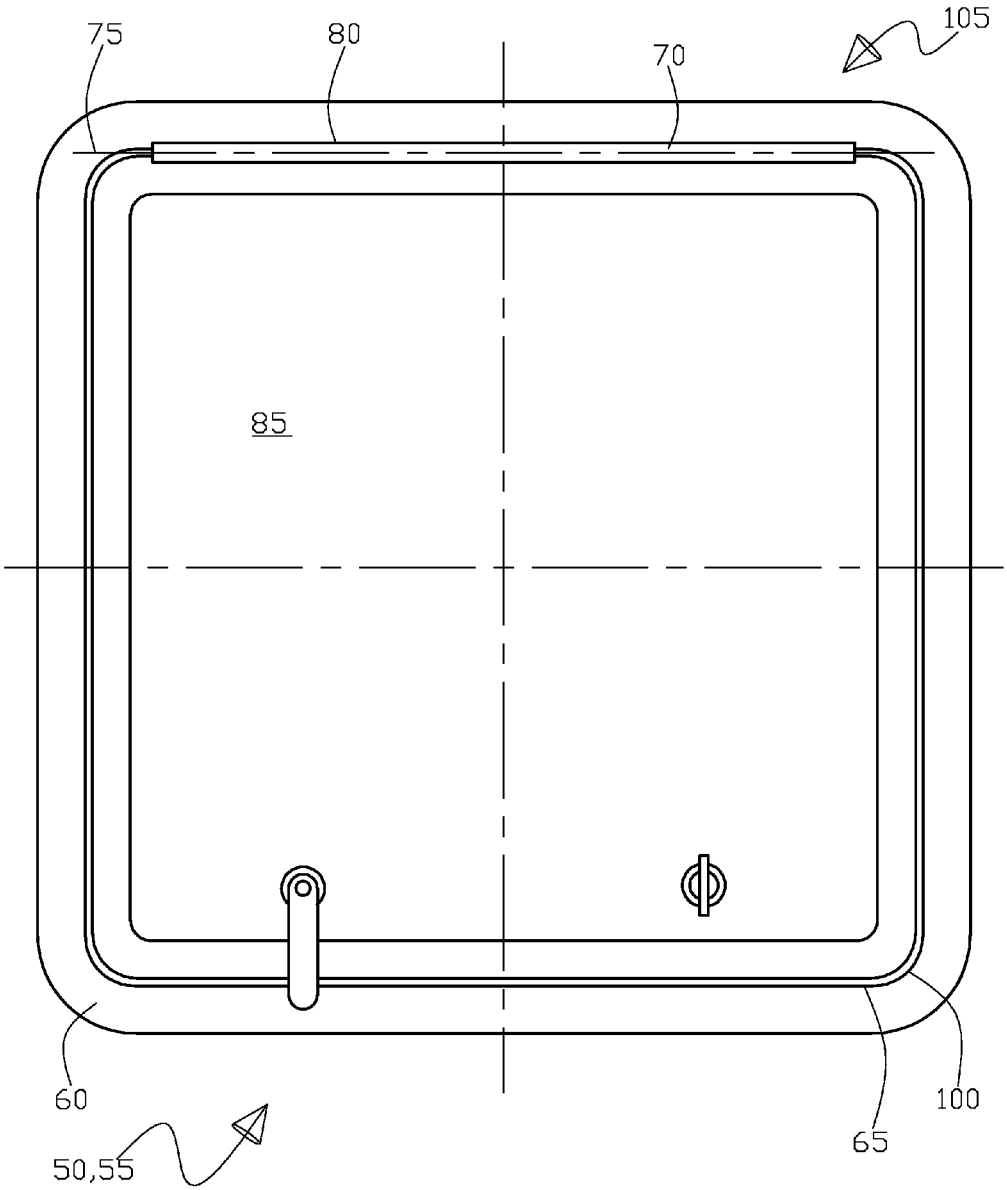
FIG. 2 shows an outside flat view the door urging apparatus and the door apparatus including the door, the frame, the frame perimeter, the hinge, and the hinge pivotal axis, all in the closed operational state.
Figure 3:
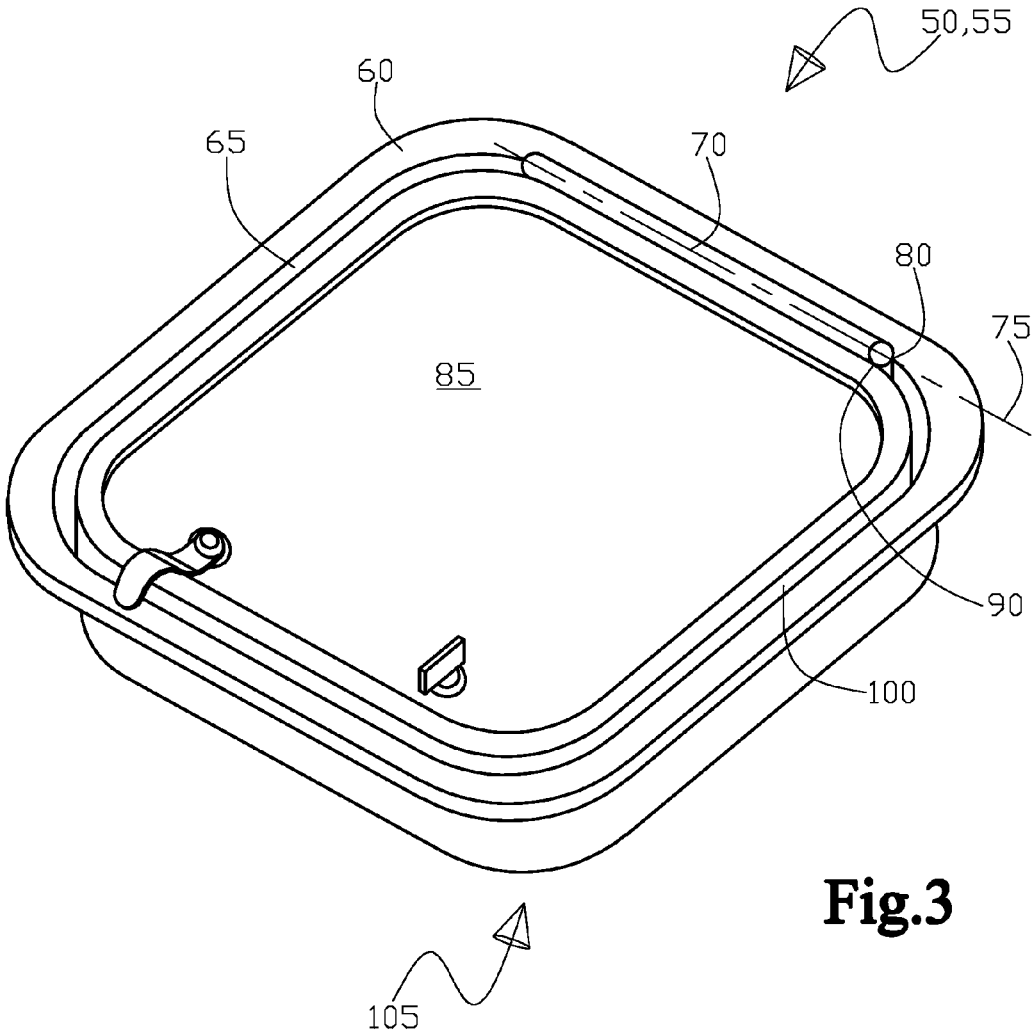
FIG. 3 shows an outside perspective view the door urging apparatus and the door apparatus including the door, the frame, the frame perimeter, the hinge, and the hinge pivotal axis, all in the closed operational state.

With initial reference to FIG. 1 shown is an inside flat view of the door urging apparatus 50 and the door apparatus 55 including the door 85, the frame 60, the frame perimeter 65, the offset bracket 130, the base 135, the reinforcement element 170, the arcuate planar element 185, the first 200 and second 210 pivotal attachments, and the gas spring assembly 275, all in the closed operational state 105. Next, FIG. 2 shows an outside flat view the door urging apparatus 50 and the door apparatus 55 including the door 85, the frame 60, the frame perimeter 65, the hinge 70, and the hinge pivotal axis 75, all in the closed operational state 105. Further, FIG. 3 shows an outside perspective view the door urging apparatus 50 and the door apparatus 55 including the door 85, the frame 60, the frame perimeter 65, the hinge 70, and the hinge pivotal axis 75, all in the closed operational state 105. Continuing, FIG. 4 shows an inside perspective view of the door urging apparatus 50 and the door apparatus 55, including the door 85, the frame 60, the frame perimeter 65, the offset bracket 130, the base 135, the reinforcement element 170, the arcuate planar element 185, the perpendicular relationship 165 as between the base 135 and the arcuate planar element 185, the first 200 and second 210 pivotal attachments, and the gas spring assembly 275, all in the closed operational state 105.

Figure 4:
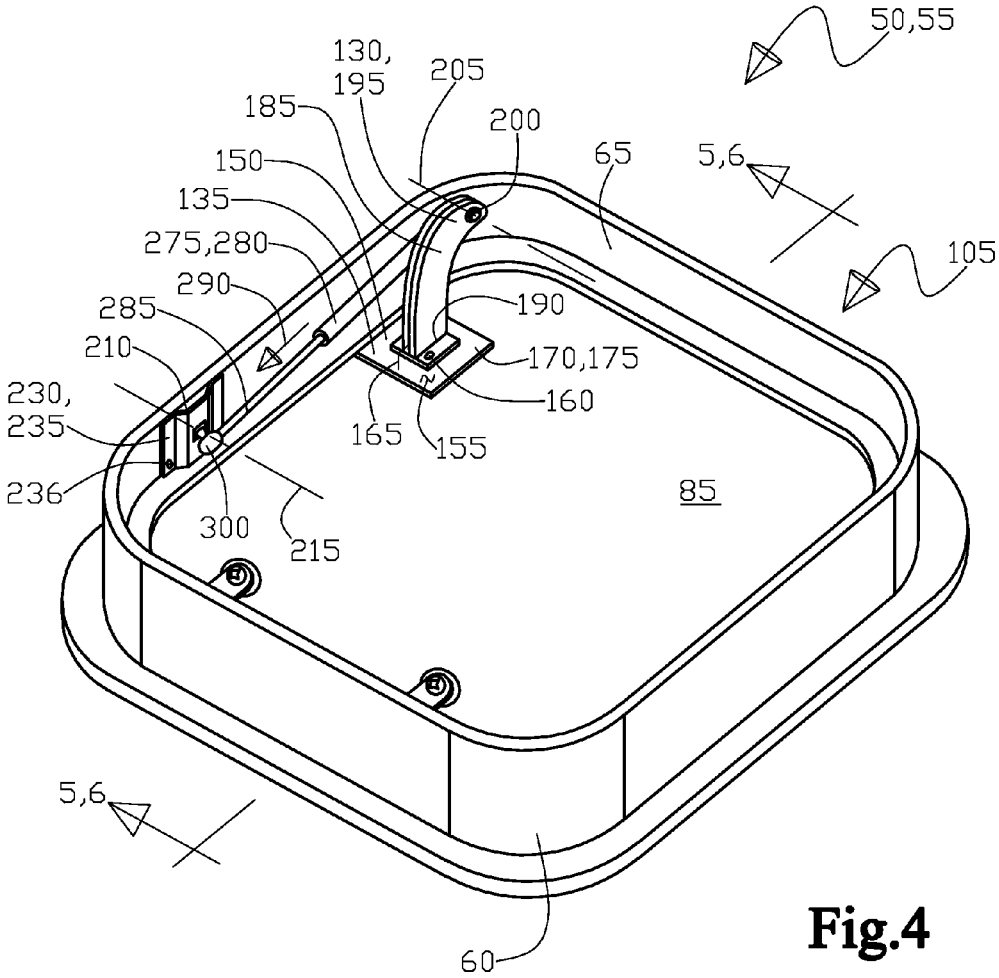
FIG. 4 shows an inside perspective view of the door urging apparatus and the door apparatus including the door, the frame, the frame perimeter, the offset bracket, the base, the reinforcement element, the arcuate planar element, the perpendicular relationship as between the base and the arcuate planar element, the first and second pivotal attachments, and the gas spring assembly, all in the closed operational state.
Figure 5:
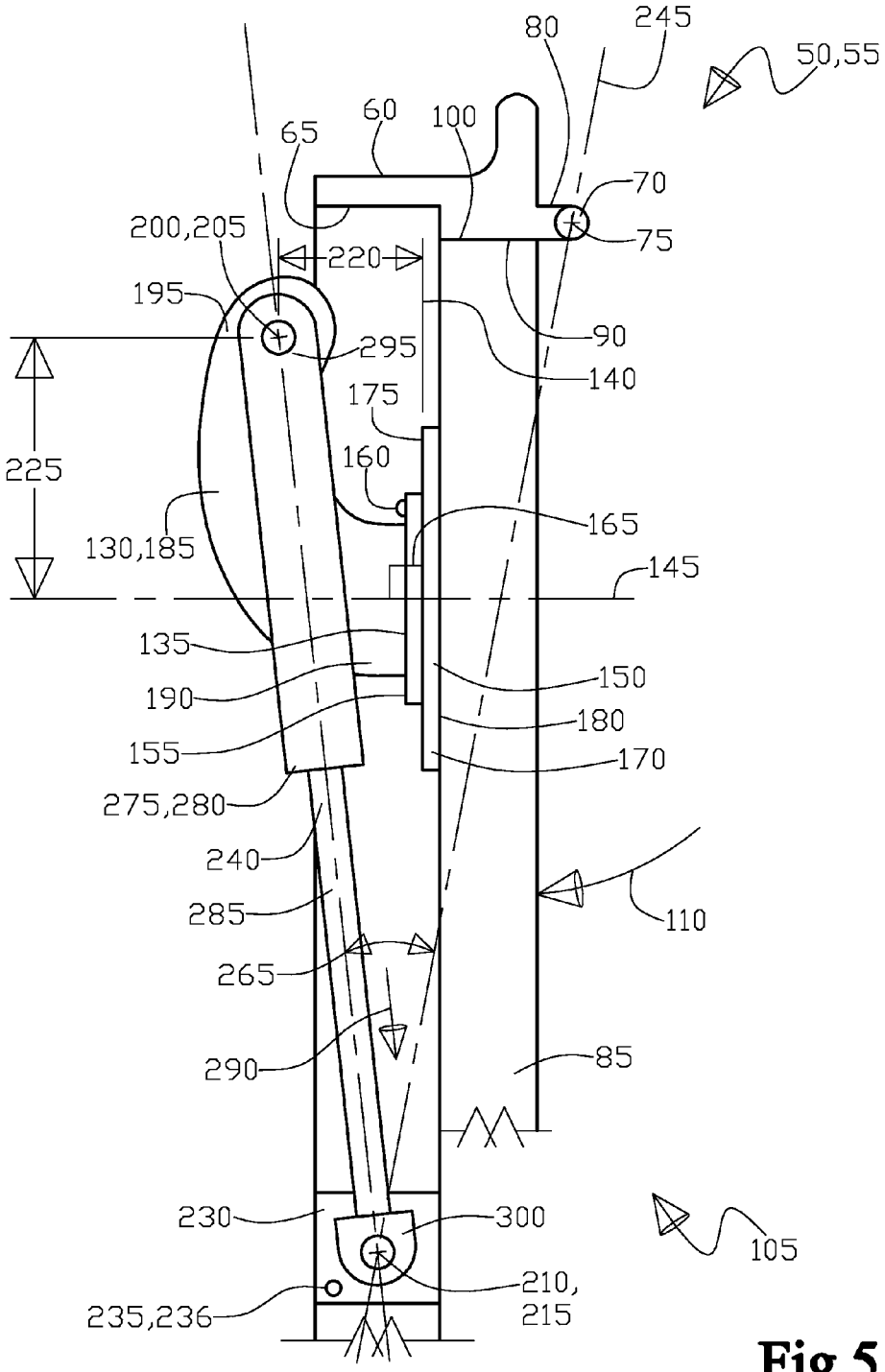
FIG. 5 shows cross section view 5-5 from FIG. 4 of the door urging apparatus and the door apparatus including the door, the frame, the frame perimeter, the offset bracket, the base, the reinforcement element, the arcuate planar element, the first and second pivotal attachments, and the gas spring assembly, also shown in particular is the hinge, the hinge pivotal axis, the urging of the door into the closed operational state, the connective axis, the relational axis, and the adjacent acute angle, all in the closed operational state.

Further, FIG. 5 shows cross section view 5-5 from FIG. 4 of the door urging apparatus 50 and the door apparatus 55 including the door 85, the frame 60, the frame perimeter 65, the offset bracket 130, the base 135, the reinforcement element 170, the arcuate planar element 185, the first 200 and 210 second pivotal attachments, and the gas spring assembly 275, also shown in particular is the hinge 70, the hinge pivotal axis 75, the urging 110 of the door into the closed operational state 105, the connective axis 240, the relational axis 245, and the adjacent acute angle 265, all in the closed operational state 105. Moving onward, FIG. 6 shows cross section view 6-6 from FIG. 4 of the door urging apparatus 50 and the door apparatus 55 including the door 85, the frame 60, the frame perimeter 65, the offset bracket 130, the base 135, the reinforcement element 170, the arcuate planar element 185, the first 200 and 210 second pivotal attachments, and the gas spring assembly 275, also shown in particular is the hinge 70, the hinge pivotal axis 75, with the connective axis 240 and the relational axis 245 in alignment 250, all in the crossover operational state 115.

Figure 7:
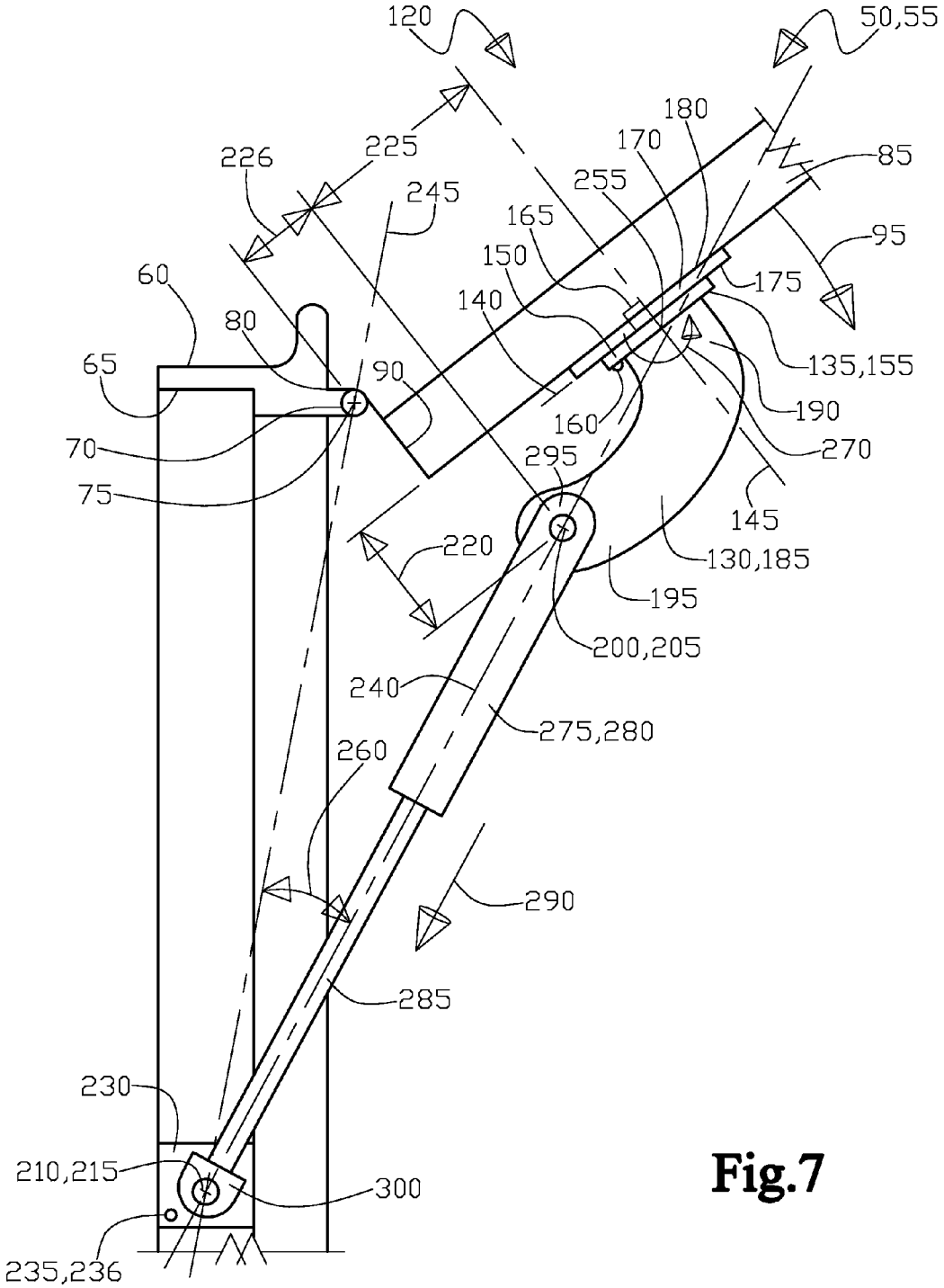
FIG. 7 shows cross section view 7-7 from FIG. 9 of the door urging apparatus and the door apparatus including the door, the frame, the frame perimeter, the offset bracket, the base, the reinforcement element, the arcuate planar element, the first and second pivotal attachments, and the gas spring assembly, also shown in particular is the hinge, the hinge pivotal axis, the urging of the door into the open operational state, the connective axis, the relational axis, and the acute angle, all in the open operational state.
Figure 8:
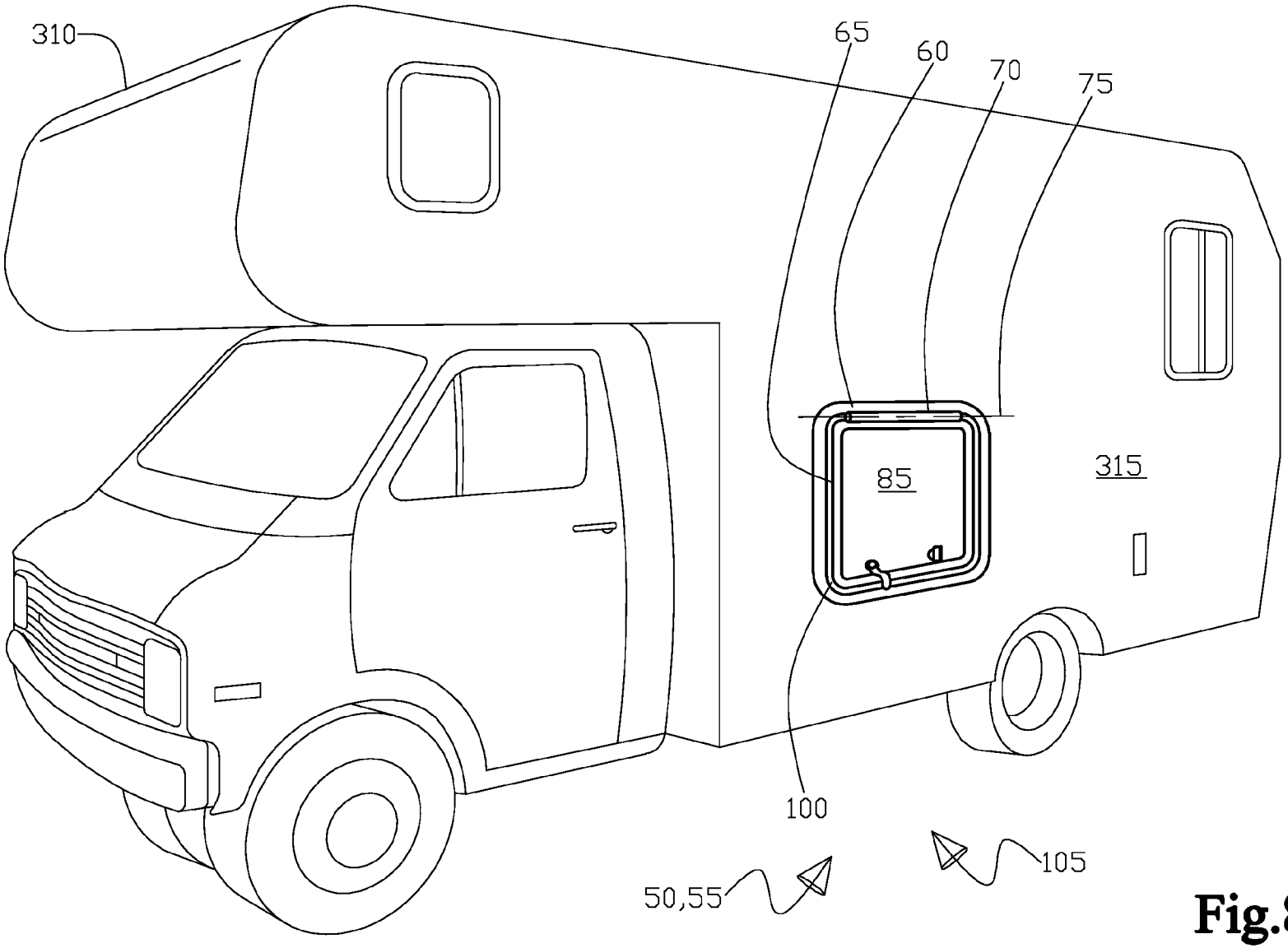
FIG. 8 shows an installed in use perspective view or the outside perspective view the door urging apparatus and the door apparatus including the door mounted in the recreational vehicle vertical panel wall, with the frame, the frame perimeter, the hinge, and the hinge pivotal axis, all in the closed operational state.
Figure 9:
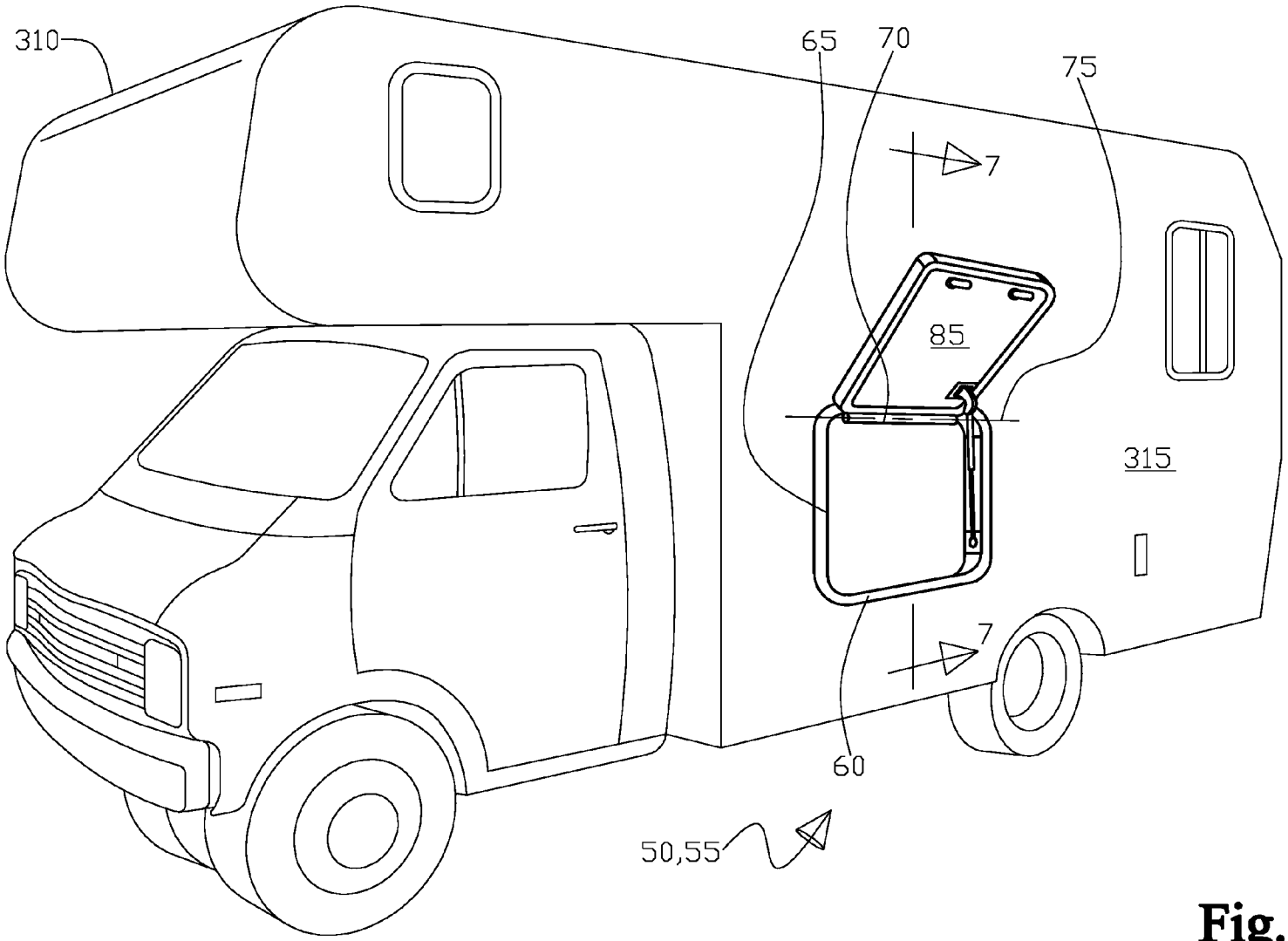
FIG. 9 shows an installed in use perspective view or the outside perspective view the door urging apparatus and the door apparatus including the door mounted in the recreational vehicle vertical panel wall, with the frame, the frame perimeter, the hinge, and the hinge pivotal axis, all in the open operational state.

Yet further, FIG. 7 shows cross section view 7-7 from FIG. 9 of the door urging apparatus 50 and the door apparatus 55 including the door 85, the frame 60, the frame perimeter 65, the offset bracket 130, the base 135, the reinforcement element 170, the arcuate planar element 185, the first 200 and 210 second pivotal attachments, and the gas spring assembly 275, also shown in particular is the hinge 70, the hinge pivotal axis 75, the urging 125 of the door into the open operational state 120, the connective axis 240, the relational axis 245, and the acute angle 260, all in the open operational state 120. Next, FIG. 8 shows an installed in use perspective view or the outside perspective view the door urging apparatus 50 and the door apparatus 55 including the door 85 mounted in the recreational vehicle 310 vertical panel wall 315, with the frame 60, the frame perimeter 65, the hinge 70, and the hinge pivotal axis 75, all in the closed operational state 105. Continuing, FIG. 9 shows an installed in use perspective view or the outside perspective view the door urging apparatus 50 and the door apparatus 55 including the door 85 mounted in the recreational vehicle 310 vertical panel wall 315, with the frame 60, the frame perimeter 65, the hinge 70, and the hinge pivotal axis 75, all in the open operational state 120. Next, FIG. 10 shows a flat layout view of the door urging apparatus kit 50 for application to an existing door 85, door frame 60, and hinge assembly 70, wherein the kit 50 includes the offset bracket 130, fasteners 160 for the offset bracket 130, the reinforcement element 170, the adhesive 180 for the reinforcement element 170, the primer 181 for the adhesive 180, the plate 230, fasteners 236 for the plate 230, the abrasive surface prep block 305, and the gas spring assembly 275.

Figure 6:
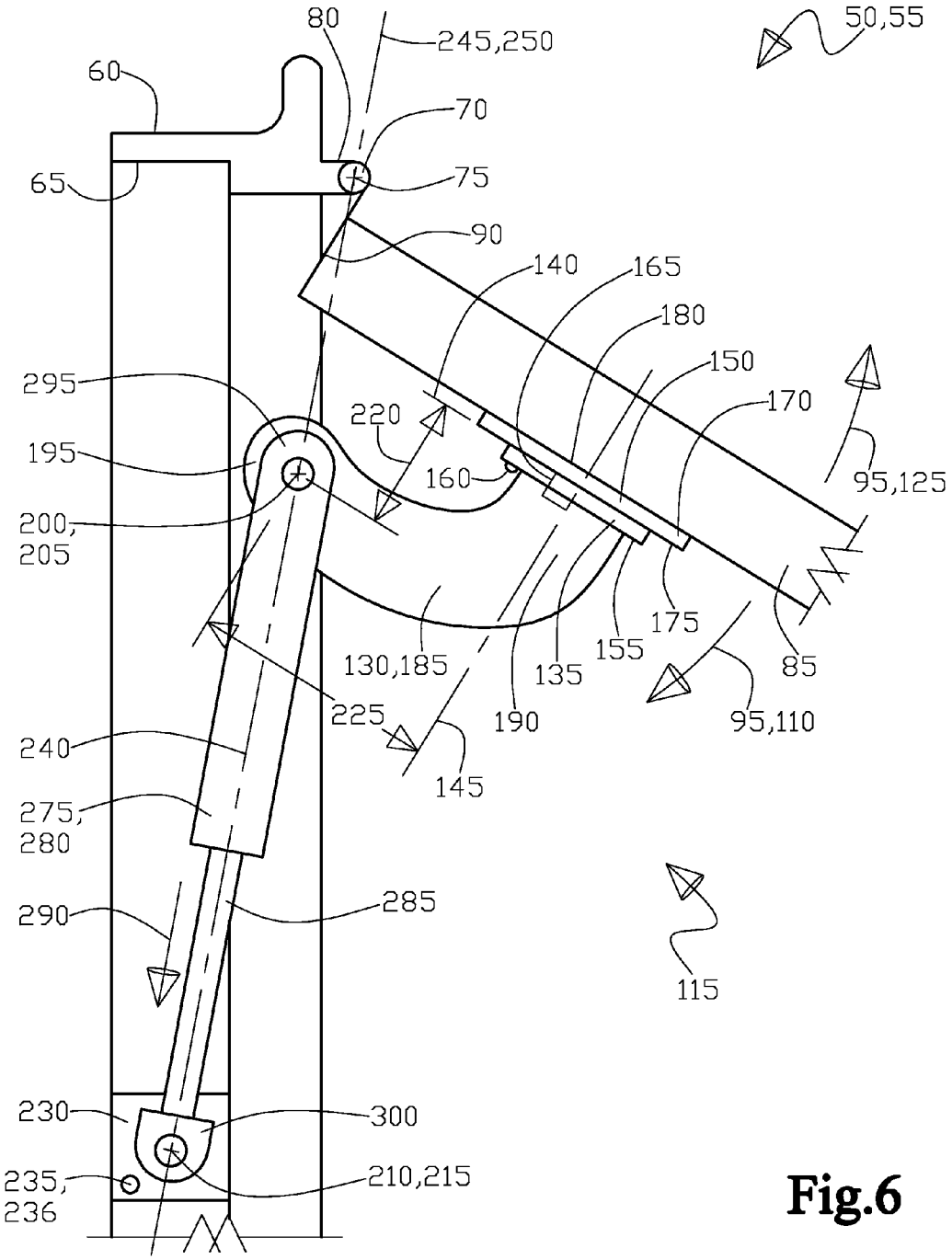
FIG. 6 shows cross section view 6-6 from FIG. 4 of the door urging apparatus and the door apparatus including the door, the frame, the frame perimeter, the offset bracket, the base, the reinforcement element, the arcuate planar element, the first and second pivotal attachments, and the gas spring assembly, also shown in particular is the hinge, the hinge pivotal axis, with the connective axis and the relational axis in alignment, all in the crossover operational state.
Figure 10:
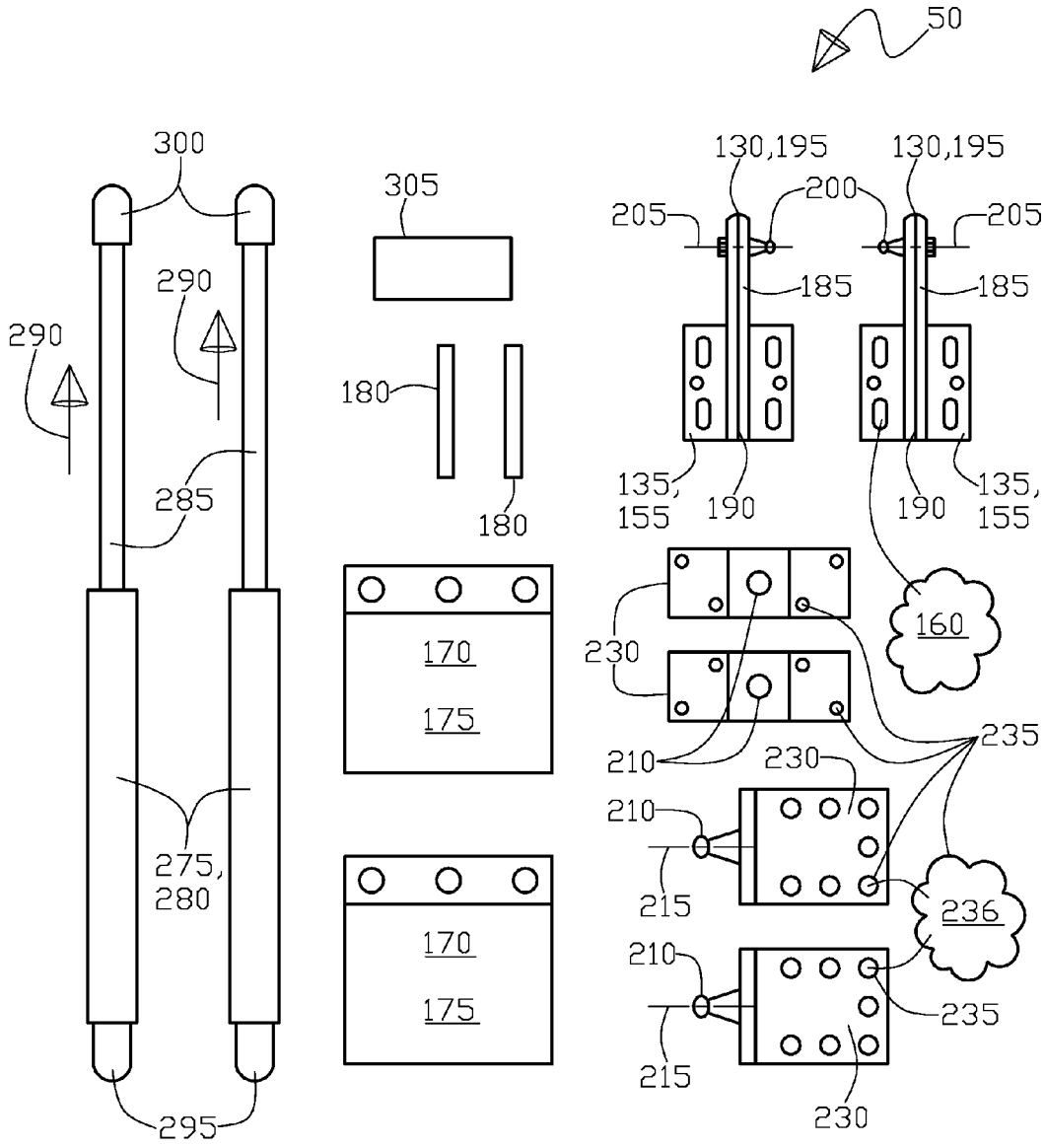
FIG. 10 shows a flat layout view of the door urging apparatus kit for application to an existing door, door frame, and hinge assembly, wherein the kit includes the offset bracket, fasteners for the offset bracket, the reinforcement element, the adhesive for the reinforcement element, the primer for the adhesive, the plate, fasteners for the plate, the abrasive surface prep block, and the gas spring assembly.

In looking at FIGS. 1 through 10, the door urging apparatus 50, in the form of a kit 50, see FIG. 10 especially, is for use with an existing door 85 hingedly 70 mounted 80 in a frame 60, the door 85 moving 95 via the hinged 70 mount 90 about a hinge axis 75 relative to the frame 60, as previously supplied or mounted in the recreational vehicle 310 vertical wall 315, see FIGS. 8 and 9, with the door 85 moving from the closed operational state 105, to the crossover operational state 115, and an open operational state 120, looking at particular to FIGS. 5, 6, and 7. The door urging apparatus 50 includes the offset bracket 130 that has a base 130 forming a plane 140, with the base 135 having a centrally positioned base axis 145 that is perpendicular 165 to the plane 140, see FIGS. 5, 6, and 7, also with an arcuate planar element 185 having a proximal end portion 190 and a distal end portion 195. Wherein the proximal end portion 190 extends substantially perpendicularly 165 therefrom the base 135 and the distal end portion 195 terminating in a first pivotal attachment 200, see FIGS. 1, 4, 5, 6, 7, and 10. The first pivotal attachment 200 having a first pivotal axis 205, wherein the first pivotal axis 205 is parallel to the plane 140 and perpendicular to the base 135 axis 145, forming a first distance 220 from the plane 140 to the first pivotal axis 205 and a second distance 225 from the base 135 axis 145 to the first pivotal axis 205, see again FIGS. 5, 6, and 7. Wherein, relationally the first distance 220 is in the range of about zero point five (0.5) to one point five (1.5)

times the second distance 225, wherein the base 135 is affixed 150 to the door 85 such that the first pivotal axis 205 and the hinge 70 axis 75 are parallel and adjacent to one another, see again FIGS. 5, 6, and 7.

Further included in the door urging apparatus 50, in the form of a kit 50 is the plate 230 including the second pivotal attachment 210 projecting therefrom, the second pivotal attachment 210 has a second pivotal axis 215 that is positioned parallel to the first pivotal axis 205, see FIG. 4. Wherein the plate 230 is affixed to a frame 60 portion opposite of the hinged 70 mount 80, wherein the connective axis 240 is formed from the first pivotal axis 205 to the second pivotal axis 215, wherein the connective axis 240 is parallel to each of the first 205 and second 215 pivotal axes, see FIGS. 5, 6, and 7. Further, a relational axis 245 is formed from the second pivotal axis 215 to the hinge 70 axis 75, wherein the relational axis 245 is perpendicular to each of the second pivotal axis 215 and the hinge 70 axis 75, see FIGS. 4 through 7. Note that the plate 230 could also be attached to other that the frame 60, i.e. being attached to another part of the structure of the recreational vehicle 310.

Additionally included in the door urging apparatus 50, is the gas spring assembly 275 having a lengthwise cylinder 280 with a rod 285 telescoping therefrom, wherein the gas spring assembly 275 provides a dampened force 290 extending said rod outward, see FIGS. 4 through 7. The gas spring assembly 275 is pivotally attached 295 and 300 respectively as between the first pivotal attachment 200 and the second pivotal attachment 210, again see FIGS. 4 through 7. Wherein, operationally the door 85 is in the cross over operational state 115 when the connective axis 240 and the relational axis 245 are in alignment 250 to one another, see FIG. 6, wherein the door 85 is urged 110 into the closed operational state 105 in going from the cross over operational state 115 to the closed operational state 105 and further the door 85 is urged 125 into the open operational state 120 in going from the cross over operational state 115 to the open operational state 120. The first 220 and second 225 distance are also sized to have the connective axis 240 intersect the base 135 and the base axis 145 intersection when the door 85 is in the open state 120 resulting in no moment 270 loading translating from the base 135 to the door 85 when the door 85 is secured in the open operational state 120, see FIG. 7, resulting in a lower loading placed upon the door 85, wherein the door 85 is typically constructed from a rigid foam core sandwiched by plastic/fiberglass laminates, thus the loading ultimately from the gas spring assembly 275 to hold the door 85 open 120 is diffused to the point of not rupturing the door 85 materials, wherein the actual door 85 loading is in shear over a wide area 175 of the reinforcement element 170 acting through the adhesive 180 to help preclude door 85 rupture, cracking, or piercing, from the from the gas spring assembly 275 force 290 to hold the door 85 open 120.

Alternatively, the door apparatus 50 can further include the reinforcing element 170 affixed between the base 135 and the door 85, wherein the reinforcing element 170 is at least three (3) times the area 155 of the base 135, wherein operationally the reinforcing element 170 reduces a per unit loading of the base 135 to the door 85 by a factor of at least three (3) stemming from the dampened force 290, see in particular FIGS. 1, 4, through 7, and 10, so as described above for the reduction of door 85 loading from the gas spring assembly 275 force 290 to hold the door 85 open 120. Further, preferably the reinforcing element 170 is constructed of a sheet material, being a steel material. In addition, for the kit 50 of the door urging apparatus 50, as shown in FIG. 10, further alternatively included is a fastener element 160 to affix the base 135 to the sheet material 170 and the adhesive 180 to affix the sheet material 170 to the door 85 being operational to minimize per unit area loading as against the door 85 loading from the gas spring assembly 275 to hold the door 85 open 120 as described above.

Note that the door urging apparatus 50 is designed to be used with an existing door 85, that is hinged 70 to the frame 60 and already installed in the recreational vehicle 310 vertical wall 315 as shown in FIGS. 8 and 9, thus the door urging apparatus 50 kit is provided as shown in FIG. 10, this as opposed to providing the door urging apparatus kit 50 plus the door 85, that is hinged 70 to the frame 60, which is defined as the door apparatus 55 below.

The door apparatus 55, includes the frame 60 forming a perimeter 65 having the hinge 70 having a hinge axis 75, with the hinge 70 being affixed 80 to a portion of the frame 60. Also included is the door 85 that is affixed 90 to the hinge 70, with the door 85 sized and configured 100 to slidably fit within the frame 60 perimeter 65 when the door 85 is in a closed operational state 105, see FIG. 5, with the door 85 also moving about 95 the hinge 70 axis 75 to the cross over operational state 5, see FIG. 6, and then to an open operational state 120, see FIG. 7.

With the door 85 moving from the closed operational state 105, to the crossover operational state 115, and to the open operational state 120, looking at particular to FIGS. 5, 6, and 7. The door apparatus 55 further including the offset bracket 130 that has a base 130 forming a plane 140, with the base 135 having a centrally positioned base axis 145 that is perpendicular 165 to the plane 140, see FIGS. 5, 6, and 7, also with the arcuate planar element 185 having a proximal end portion 190 and a distal end portion 195. Wherein the proximal end portion 190 extends substantially perpendicularly 165 therefrom the base 135 and the distal end portion 195 terminating in a first pivotal attachment 200, see FIGS. 1, 4, 5, 6, 7, and 10. The first pivotal attachment 200 having a first pivotal axis 205, wherein the first pivotal axis 205 is parallel to the plane 140 and perpendicular to the base 135 axis 145, forming a first distance 220 from the plane 140 to the first pivotal axis 205 and a second distance 225 from the base 135 axis 145 to the first pivotal axis 205, see again FIGS. 5, 6, and 7. Wherein, relationally the first distance 220 is in the range of about zero point five (0.5) to one point five (1.5) times the second distance 225, wherein the base 135 is affixed 150 to the door 85 such that the first pivotal axis 205 and the hinge 70 axis 75 are parallel and adjacent to one another, see again FIGS. 5, 6, and 7.

Further included in the door apparatus 55, is the plate 230 including the second pivotal attachment 210 projecting therefrom, the second pivotal attachment 210 has a second pivotal axis 215 that is positioned parallel to the first pivotal axis 205, see FIG. 4. Wherein the plate 230 is affixed to a frame 60 portion opposite of the hinged 70 mount 80, wherein the connective axis 240 is formed from the first pivotal axis 205 to the second pivotal axis 215, wherein the connective axis 240 is parallel to each of the first 205 and second 215 pivotal axes, see FIGS. 5, 6, and 7. Further, a relational axis 245 is formed from the second pivotal axis 215 to the hinge 70 axis 75, wherein the relational axis 245 is perpendicular to each of the second pivotal axis 215 and the hinge 70 axis 75, see FIGS. 4 through 7. In addition, wherein the first distance 220 is sized such that the connective axis 240 and the relational axis 245 form an acute angle 260 when the door 85 is in the open state 120, see FIG. 7, note that in going from FIGS. 6 to 7, the acute angle 260 urges the door 85 open 120, thus being a lift assist to move the door 85 upward from the crossover state 115, FIG. 6 to the open state 120, FIG. 7. Further, the connective axis 240 and the relational axis 245 form an adjacent acute angle 265 when the door 85 is in the closed state 105, see FIG. 5, this adjacent acute angle 265 facilitates the door 85 being urged into the closed state 105, thus keeping the door closed 105 in the event of the door 85 being left unlocked, the lock breaking, and not requiring the user to manually hold down the door 85 in the closed state 105 while at the same time trying to lock it, which would increase the difficulty of doing so.

Additionally included, in the door apparatus 55 is the gas spring assembly 275 having a lengthwise cylinder 280 with a rod 285 telescoping therefrom, wherein the gas spring assembly 275 provides a dampened force 290 extending said rod outward, see FIGS. 4 through 7. The gas spring assembly 275 is pivotally attached 295 and 300 respectively as between the first pivotal attachment 200 and the second pivotal attachment 210, again see FIGS. 4 through 7. Wherein, operationally the door 85 is in the cross over operational state 115 when the connective axis 240 and the relational axis 245 are in alignment 250 to one another, see FIG. 6, wherein the door 85 is urged 110 into the closed operational state 105 in going from the cross over operational state 115 to the closed operational state 105 and further the door 85 is urged 125 into the open operational state 120 in going from the cross over operational state 115 to the open operational state 120.

Alternatively, the door apparatus 55 can further include the reinforcing element 170 affixed between the base 135 and the door 85, wherein the reinforcing element 170 is at least three (3) times the area 155 of the base 135, wherein operationally the reinforcing element 170 reduces a per unit loading of the base 135 to the door 85 by a factor of at least three (3) stemming from the dampened force 290, see in particular FIGS. 1, 4, through 7, and 10 so as described above for the reduction of door 85 loading from the gas spring assembly 275 to hold the door 85 open 120. Further, preferably the reinforcing element 170 is constructed of a sheet material, being a steel material. In addition, for the door apparatus 55, as shown in FIG. 10, further alternatively included is a fastener element 160 to affix the base 135 to the sheet material 170 and the adhesive 180 to affix the sheet material 170 to the door 85 being operational to minimize area loading as against the door 85 loading from the gas spring assembly 275 to hold the door 85 open 120 as described above.

Note that for the installed version as applying to either the door urging apparatus 50 or the door apparatus 55, the reinforcement element 170 is preferably 4 inches square and of 22 gauge in thickness, for fasteners 160 are preferably #6 by ½ inch long self-piercing screws, and for fasteners 236 are preferably #10 by ⅝ inches long self tapping screws, the door 85 is typically 2 feet square by 1 inch thick being constructed of a foam core with an outer surface laminate of fiberglass sheet and an inner laminate of LAMILUX plastic sheet or other equivalent materials, note that the door size could be larger or smaller, the abrasive 305 is preferably SCOTCHBRITE, the adhesive 180 is preferably a 3M brand number 5925, the primer 181 is preferably a 3M brand number 94, and the gas spring assembly 275 has dampened force 290 of about thirty pounds. The first distance 220 is preferably about two point two-five (2.25) inches and the second distance 225 is preferably about two point seven-five (2.75) inches, further the acute angle 260 is preferably about twenty (20) degrees and the adjacent angle 265 is preferably about fifteen (15) degrees.

CONCLUSION

Accordingly, the present invention of a door urging apparatus 50 and door apparatus 55 has been described with some degree of particularity directed to the embodiments of the present invention. It should be appreciated, though, that the present invention is defined by the following claims construed in light of the prior art so modifications or changes may be made to the exemplary embodiments of the present invention without departing from the inventive concepts contained therein.

The invention claimed is:

1. A door urging apparatus, comprising:

(a) a door hingedly mounted with a hinge to a frame that has a frame perimeter, said door operationally moving via said hinge about a hinge axis relative to said frame between a closed operational state, a crossover operational state, and an open operational state, said open operational state defined as said door disposed completely outside of said frame perimeter with said door being disposed completely outside of said frame perimeter to allow full open access within said frame perimeter when said door is in said open operational state;

(b) an offset bracket that includes a base forming a plane, said base having a centrally positioned base axis that is perpendicular to said plane, said offset bracket further includes an arcuate planar element having a proximal end portion and a distal end portion, wherein said proximal end portion extends perpendicularly from said base and said distal end portion including a first pivotal attachment, said first pivotal attachment having a first pivotal axis, wherein said first pivotal axis is parallel to said plane and perpendicular to said base axis and defining a first distance from said plane and a second distance from said base axis, wherein said first distance is in the range of about zero point five (0.5) to about one point five (1.5) times said second distance, wherein said base is affixed to said door such that said first pivotal axis and said hinge axis are parallel and adjacent to one another;

(c) a reinforcing element affixed between said base and said door, said reinforcing element is constructed of a sheet material that is planar, wherein said reinforcing element is at least three (3) times a planar surface area of said base plane, wherein said offset bracket has said first pivotal attachment that lays outside of a perpendicular projection of said reinforcing element and a perpendicular projection of said base, said perpendicular projection of said reinforcing element and said perpendicular projection of said base are both being perpendicular to said door and extending towards said offset bracket, wherein said reinforcing element and said base are parallel to said base plane and wherein said first pivotal attachment forms said second distance;

(d) a plate affixed to said frame, said plate including a second pivotal attachment projecting therefrom, said second pivotal attachment has a second pivotal axis that is positioned parallel to said first pivotal axis, wherein said plate is affixed to a portion of said frame opposite of said hinged mount, wherein a connective axis is formed from said first pivotal axis to said second pivotal axis, wherein said connective axis is perpendicular to each of said first and second pivotal axes, further a relational axis is formed from said second pivotal axis to said hinge axis, wherein said relational axis is perpendicular to each of said second pivotal axis and said hinge axis; and (e) a gas spring assembly having a lengthwise cylinder with a rod telescoping therefrom, wherein said gas spring assembly provides a dampening force extending said rod outward, said gas spring assembly is pivotally attached between said first pivotal attachment and said second pivotal attachment, wherein operationally said door is in said cross over operational state when said connective axis and said relational axis are in alignment to one another, wherein said door is urged into said closed operational state in going from said cross over operational state to said closed operational state and further said door is urged into said open operational state in going from said cross over operational state to said open operational state, said offset bracket said first and second distances are also sized and configured to have said connective axis intersect said base and said base axis intersection when said door is in said open state, further operationally said reinforcing element reduces a per unit loading in force per unit area of said base to said door by a factor of at least three (3) stemming from said dampened force.

2. A door urging apparatus according to claim 1 further comprising a fastener element to affix said base to said sheet material and an adhesive to affix said sheet material to said door, being operational to minimize area loading in force per unit area from said dampened force as against said door via said sheet material planar surface area increase over an area of said base plane.

3. A door apparatus, comprising:

(a) a frame forming a frame perimeter;

(b) a hinge having a hinge axis, said hinge is affixed to a portion of said frame;

(c) a door that is affixed to said hinge, said door sized and configured to slidably fit within said frame perimeter when said door is in a closed operational state, said door also moving about said hinge axis to a cross over operational state and to an open operational state, said open operational state defined as said door disposed completely outside of said frame perimeter with said door being disposed completely outside of said door hinge to allow full open access within said frame perimeter when said door is in said open operational state;

(d) an offset bracket that includes a base forming a plane, said base having a centrally positioned base axis that is perpendicular to said plane, said offset bracket further includes an arcuate planar element having a proximal end portion and a distal end portion, wherein said proximal end portion extends perpendicularly from said base and said distal end portion including a first pivotal attachment, said first pivotal attachment having a first pivotal axis, wherein said pivotal axis is parallel to said plane and perpendicular to said base axis and defining a first distance from said plane and a second distance from said base axis, wherein said first distance is in the range of about zero point five (0.5) to about one point five (1.5) times said second distance, wherein said base is affixed adjacent to said hinge, such that said first pivotal axis and said hinge axis are parallel and adjacent to one another;

(e) a reinforcing element affixed between said base and said door, said reinforcing element is constructed of a sheet material that is planar, wherein said reinforcing element is at least three (3) times a planar surface area of said base plane, wherein said offset bracket has said first pivotal attachment that lays outside of a perpendicular projection of said reinforcing element and a perpendicular projection of said base, said perpendicular projection of said reinforcing element and said perpendicular projection of said base are both being perpendicular to said door and extending towards said offset bracket, wherein said reinforcing element and said base are parallel to said base plane and wherein said first pivotal attachment forms said second distance;

(f) a plate affixed to said frame, said plate including a second pivotal attachment projecting therefrom, said second pivotal attachment has a second pivotal axis that is positioned parallel to said first pivotal axis, wherein said plate is affixed to a portion of said frame opposite of said affixed hinge, wherein a connective axis is formed from said first pivotal axis to said second pivotal axis, wherein said connective axis is perpendicular to each of said first and second pivotal axes, further a relational axis is formed from said second pivotal axis to said hinge axis, wherein said relational axis is perpendicular to each of said second pivotal axis and said hinge axis, wherein said first distance is sized such that said connective axis and said relational axis form an acute angle when said door is in said open state and said connective axis and said relational axis form an adjacent acute angle when said door is in said closed state; and (g) a gas spring assembly having a lengthwise cylinder with a rod telescoping therefrom, wherein said gas spring assembly provides a dampening force extending said rod outward, said gas spring assembly is pivotally attached between said first pivotal attachment and said second pivotal attachment, wherein operationally said door is in said cross over operational state when said connective axis and said relational axis are in alignment to one another, wherein said door is urged into said closed operational state in going from said cross over operational state to said closed operational state and further said door is urged into said open operational state in going from said cross over operational state to said open operational state, said offset bracket said first and second distances are also sized and configured to have said connective axis intersect said base and said base axis intersection when said door is in said open state, further operationally said reinforcing element reduces a per unit loading in force per unit area of said base to said door by a factor of at least three (3) stemming from said dampening force.

4. A door apparatus according to claim 3 further comprising a fastener element to affix said base to said sheet material and an adhesive to affix said sheet material to said door, being operational to minimize area loading in force per unit area from said dampened force as against said door via said sheet material planar surface area increase over an area of said base plane.

* * * * *